US007731820B2

(12) United States Patent
Cockcroft et al.

(10) Patent No.: US 7,731,820 B2
(45) Date of Patent: Jun. 8, 2010

(54) COMPOSITIONS OF FLUORESCENT WHITENING AGENTS

(75) Inventors: Robert Cockcroft, Bradford (GB); Ted Deisenroth, Brookfield, CT (US); Peter Rohringer, Schönenbuch (CH); Winfried Steffen, Lörrach (DE)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 322 days.

(21) Appl. No.: 11/665,886

(22) PCT Filed: Oct. 17, 2005

(86) PCT No.: PCT/EP2005/055301

§ 371 (c)(1),
(2), (4) Date: Aug. 30, 2007

(87) PCT Pub. No.: WO2006/045714

PCT Pub. Date: May 4, 2006

(65) Prior Publication Data

US 2008/0073617 A1 Mar. 27, 2008

(30) Foreign Application Priority Data

Oct. 27, 2004 (EP) ..... 04105343

(51) Int. Cl.
*D21H 21/30* (2006.01)
*D21H 17/37* (2006.01)
*D21H 17/53* (2006.01)

(52) U.S. Cl. ..... 162/162; 162/168.3; 162/158; 162/184; 162/231; 252/301.23; 252/301.21

(58) Field of Classification Search ..... 162/158, 162/162, 168.3, 184, 231; 252/301.21, 301.23
See application file for complete search history.

(56) References Cited

U.S. PATENT DOCUMENTS

| | | | | |
|---|---|---|---|---|
| 4,670,183 | A | 6/1987 | Louman et al. | 252/301.35 |
| 4,717,502 | A | 1/1988 | Schmid | 252/301.23 |
| 5,830,241 | A | 11/1998 | Rohringer et al. | 8/552 |
| 6,365,737 | B1 | 4/2002 | Metzger et al. | 544/193.2 |
| 6,620,294 | B1 | 9/2003 | Jokinen et al. | 162/162 |
| 6,736,936 | B1 | 5/2004 | Weston et al. | 162/135 |
| 6,969,444 | B2 * | 11/2005 | Linhart et al. | 162/135 |
| 2003/0236326 | A1 * | 12/2003 | Drenker et al. | 524/100 |
| 2004/0074021 | A1 | 4/2004 | Farrar et al. | 8/648 |
| 2004/0182533 | A1 | 9/2004 | Blum et al. | 162/135 |
| 2004/0238791 | A1 | 12/2004 | Champ et al. | 252/301.35 |
| 2005/0061461 | A1 | 3/2005 | Linhart et al. | 162/158 |
| 2006/0260509 | A1 * | 11/2006 | Evers | 106/234 |

FOREIGN PATENT DOCUMENTS

| | | |
|---|---|---|
| EP | 0 145 267 | 6/1985 |
| GB | 2 294 708 | 5/1996 |
| WO | 99/42454 | 8/1999 |
| WO | 01/07714 | 2/2001 |
| WO | 01/12900 | 2/2001 |
| WO | 02/055646 | 7/2002 |
| WO | 03/021041 | 3/2003 |
| WO | 03/052205 | 6/2003 |

* cited by examiner

*Primary Examiner*—Eric Hug
*Assistant Examiner*—Dennis Cordray
(74) *Attorney, Agent, or Firm*—Shiela A. Loggins

(57) ABSTRACT

The invention relates to a composition comprising a) at least one water-soluble fluorescent whitening agent, b) a polymer formed from an ethylenically unsaturated monomer or monomer blend, characterized in that at least one monomer is acrylamide and the water-soluble polymer has an average (weight average) molecular weight of between 500 and 49,000, optionally, c) polyethylene glycol with a weight average molecular weight of between 500 and 6000 and d) water and the use of the composition for the fluorescent whitening of paper in coating and size press or film press applications.

14 Claims, No Drawings

COMPOSITIONS OF FLUORESCENT WHITENING AGENTS

This application is a 371 of PCT/EP05/55301, filed Oct. 17, 2005 which claims the benefit of European Application No. 04105343.0, filed Oct. 27, 2004.

The present invention relates to an aqueous composition comprising, essentially, at least one water-soluble fluorescent whitening agent, a polymer formed from an ethylenically unsaturated monomer and, optionally, polyethylene glycol, useful for the fluorescent whitening of paper in coating and size press or film press applications.

It is known to apply pigment coating compositions to the surface of formed paper or board to improve certain properties such as printability, gloss and optical characteristics, for example, whiteness. These pigment coating compositions are known as coating colours. Typically a coating composition is applied to the paper surface as an aqueous dispersion comprising a blend of pigments with binder.

Generally a coating colour composition comprises one or more pigments, fluorescent whitening agents (FWA's), binders, rheology modifiers and, optionally, other auxiliaries such as preservatives, pH controlling agents and lubricants.

Fluorescent whitening agents suitable for such coating compositions are generally anionic and, in combination with other components of these coating colours, often do not realize there full whitening potential when applied to paper surfaces.

The use of polyvinyl alcohols as so-called boosters or activators for FWA's has long been known, as have the problems arising with respect to the rheology of coating colours containing them.

One attempt to overcome this problem has been disclosed in EP 145,267 A2, which relates to a composition comprising an FWA and an activating amount of a polymer, including a copolymer of a hydroxyalkyl methacrylate.

However, despite the fact that no problems regarding rheology of the coatings appear forthcoming, the maximum degrees of whiteness obtainable by this composition lie considerably below those attainable by addition of polyvinyl alcohols.

In U.S. Pat. No. 4,717,502, a composition comprising particular anilino derivatives of 4,4'-bistriazinyl-aminostilbene-2,2'-disulphonic acid FWA together with polyethylene glycols of molecular weight from 1000 to 3000 is disclosed, which is useful for coating paper and achieving high degrees of whiteness. However, no values are given to support this contention.

Consequently, there is a need to provide activators or boosters for use in surface coatings containing FWA's, the effects of which are to deliver a maximum of whiteness whilst maintaining desirable rheology properties.

WO 01/07714 A1 discloses certain acrylamide copolymers, having average molecular weights of from 50,000 to 500,000, useful as rheology modifiers in aqueous coating colour dispersions.

However, no particular improvement in degree of whiteness is observed and the preferred average molecular weight of the polymers lies by 200,000.

Surprisingly, it has now been found that the addition of certain acrylamide homo- and copolymers of relatively low average molecular weights to a coating colour results, not only in extremely high degrees of whiteness of the coated papers, superior to those obtainable by the use of polyethylene glycol boosters, but also no problems with regard to rheology are observed during coating.

Accordingly, the present invention relates to a composition comprising a) at least one water-soluble fluorescent whitening agent, b) a polymer formed from an ethylenically unsaturated monomer or monomer blend, characterized in that at least one monomer is acrylamide and the polymer has an average (weight average) molecular weight of between 500 and 49,000, optionally, c) polyethylene glycol with a weight average molecular weight of between 500 and 6000 and d) water.

Preferably, the fluorescent whitening agents are those normally employed for whitening cellulosic fibres and are selected from compounds of the 4,4'-bistriazinylaminostilbene-2,2'-disulphonic acid derivatives of the formula (1)

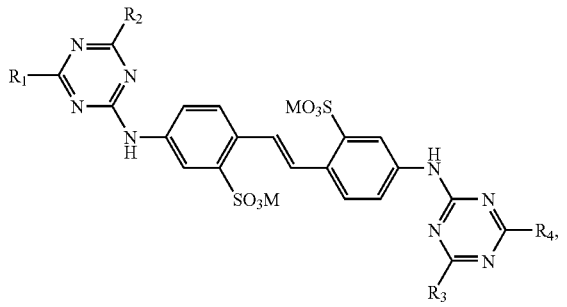

in which $R_1$, $R_2$, $R_3$ and $R_4$ each, independently, represent —$NH_2$, —$OC_1$-$C_4$alkyl, —Oaryl, —$NHC_1$-$C_4$alkyl, —N($C_1$-$C_4$alkyl)$_2$, —N($C_1$-$C_4$alkyl)($C_2$-$C_4$hydroxyalkyl), —$NHC_2$-$C_4$hydroxyalkyl, —N($C_2$-$C_4$hydroxyalkyl)$_2$, or —NHaryl, whereby aryl is phenyl, which may be unsubstituted or substituted by one or two sulphonic acid groups, —COOH, —$COOC_1$-$C_4$alkyl, —$CONH_2$, —$CONHC_1$-$C_4$alkyl or by —CON($C_1$-$C_4$alkyl)$_2$, a morpholino, piperidino or pyrrolidino residue, —$SC_1$-$C_4$alkyl or aryl, or an amino acid or amino acid amide residue from which a hydrogen atom has been abstracted from the amino group and M represents hydrogen, an alkaline or alkaline earth metal, ammonium or ammonium that is mono-, di-, tri- or tetrasubstituted by $C_1$-$C_4$alkyl or $C_2$-$C_4$hydroxyalkyl and from the distyryl biphenyl derivatives of the formula (2)

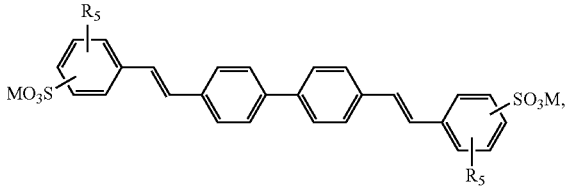

in which $R_5$ represents hydrogen, chlorine or $C_1$-$C_4$alkoxy and

M is as defined above, and mixtures thereof.

Of the compounds of formula (1), most suitable for use as component a) of the composition are those bis-triazinylaminostilbene disulphonic acids in which $R_1$ and $R_3$ are identical and $R_2$ and $R_4$ are identical and each independently represent —$NH_2$, —$NHC_1$-$C_4$alkyl, —$N(C_1$-$C_4$alkyl$)_2$, —$N(C_1$-$C_4$alkyl)($C_2$-$C_4$hydroxyalkyl), —$N(C_2$-$C_4$ hydroxyalkyl$)_2$, —NHaryl, in which aryl is unsubstituted phenyl or phenyl which is substituted by one or two —$SO_3M$ groups, a morpholino residue or an amino acid or amide residue from which a hydrogen atom has been abstracted from the amino group.

Preferred amino acid or amino acid amide residue from which a hydrogen atom has been removed are those derived from glycine, alanine, serine, cysteine, phenylalanine, tyrosine (4-hydroxyphenylalanine), diiodotyrosine, tryptophan (β-indolylalanine), histidine ((β-imidazolylalanine), α-aminobutyric acid, methionine, valine (α-aminoisovaleric acid), norvaline, leucine (α-aminoisocaproic acid), isoleucine (α-amino-β-methylvaleric acid), norleucine (α-amino-n-caproic acid), arginine, ornithine (α,δ-diaminovaleric acid), lysine (α,ε-diaminocaproic acid), aspartic acid (aminosuccinic acid), glutamic acid (α-aminoglutaric acid), threonine, hydroxyglutamic acid and taurine, as well as mixtures and optical isomers thereof, glycine and aspartic acid being especially preferred.

A further preferred example of an amino acid from which an amino acid residue may be derived is iminodiacetic acid or the mono- or diacid amide thereof, whilst a suitable amino acid amide is 2-hydroxyethylaminopropionamide.

Preferred distyryl biphenyl fluorescent whitening agents as component a) of the composition, are those selected from the compounds of formulae in which M' represents hydrogen, lithium, potassium or sodium, whereby the 2,2'-disulphonic acid derivatives of formula (3) are most preferred.

Within the scope of the definitions of the substituents in the compounds of formulae (1) and (2), $C_1$-$C_4$alkyl radicals are branched or unbranched and are, for example, methyl, ethyl, propyl, isopropyl or n-, sec- or tert-butyl; they may be unsubstituted or substituted by halogen, for example fluorine, chlorine or bromine. $C_1$-$C_4$alkoxy is, for example, methoxy, ethoxy, propoxy, isopropoxy or n-butoxy whilst $C_2$-$C_4$hydroxyalkyl is, for example, hydroxyethyl, hydroxypropyl or hydroxybutyl.

The fluorescent whitening agents are known compounds or may be prepared by known methods.

In one preferred aspect of the invention, the polymer, component b) of the composition, is a homopolymer, comprising repeating units, which are derived solely from acrylamide.

In a further preferred aspect, however, the polymer, component b) of the composition, may be a polymer, comprising repeating units, which are derived, in addition to acrylamide, from monomers selected from the group consisting of methacrylamide, hydroxyalkyl acrylates, such as hydroxymethyl and hydroxyethyl acrylate, hydroxyalkyl methacrylates, such as hydroxymethyl and hydroxyethyl methacrylate, N-alkyl acrylamides, such as N-methyl and N-ethyl acrylamide, N-alkyl methacrylamides, such as N-methyl and N-ethyl methacrylamide, N-hydroxyalkyl acrylamides, N,N-dialkyl acrylamides, such as N,N-diethyl and, especially N,N-dim- (3)

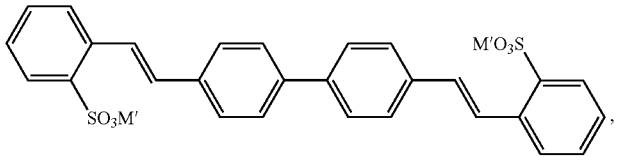

(4)

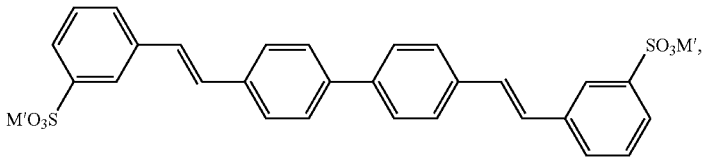

(5)

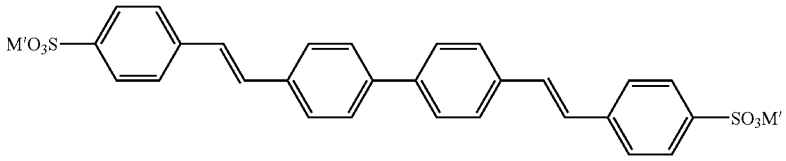

and (6)

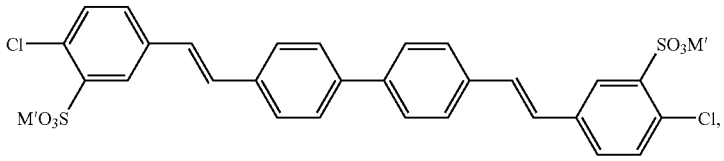

ethyl acrylamide, N,N-dialkyl methacrylamides, such as N,N-dimethyl and N,N-diethyl methacrylamide, N,N-di(hydroxyalkyl)acrylamides, such as N,N-di(2-hydroxyethyl) acrylamide, morpholino acrylamide, in particular, acrylic acid, and also methacrylic acid, itaconic acid, crotonic acid, 2-acrylamido-2-methylpropane sulphonic acid, allyl sulphonic acid and vinyl sulphonic acid, whereby the acidic monomers are in the form of their free acid or water-soluble salts, such as their alkali metal (e.g. lithium, potassium or sodium) or ammonium salts.

Preferably, the weight average molecular weights of the polymers lie within the range of from 500 to 40,000, a range of from 1,000 to 25,000 being most preferred.

The polymers useful for the composition of the invention are known polymeric materials or may be prepared by known polymerization procedures.

The ratios of the various components of the composition may vary over large ranges. Thus for example, the ratio of the water-soluble fluorescent whitening agent, component a), to polymer, component b), may vary from 1 to 0.1 to 1 to 5 parts by weight, but is preferably within the range of from 1 to 0.2 to 1 to 4 parts by weight and, especially, from 1 to 0.5 to 1 to 3 parts by weight, whilst the composition contains at least 20% by weight of water.

In certain cases, it may be advantageous to complement the composition with polyethylene glycols of weight average molecular weights of between 500 and 6000. However, polyethylene glycols having weight average molecular weights of from 1,000 to 6,000 are most suitable, polyethylene glycol 1500 being most preferred.

When polyethylene glycols are present, similar amounts are used as for the polymers mentioned above. That is to say, the ratio of the water-soluble fluorescent whitening agent, component a), to the polyethylene glycol, component c), may vary from 1 to 0.1 to 1 to 5 parts by weight, but is preferably within the range of from 1 to 0.2 to 1 to 4 parts by weight and, especially, from 1 to 0.5 to 1 to 3 parts by weight.

The whitening compositions of the invention are prepared by mechanical mixing of the components a), b), optionally, c) and d) and stirring until the mixture is homogeneous.

The amount of the composition for use according to the invention employed in the paper coating composition depends on the desired whitening effect; but usually corresponds to an amount containing from 0.01 to 5% by weight of the fluorescent whitening agent The paper coating compositions generally have a solids content of from 35 to 80% by weight, preferably from 40 to 70% by weight. In addition to 0.01 to 10 parts by weight of the whitening composition of the invention, they generally comprise, per 100 parts of inorganic pigment, (i) from 3 to 25 parts by weight of binder and co-binder,
(ii) 0 to 1 part by weight of rheology modifier,
(iii) 0 to 2 parts by weight of wet-strength agent and
(iv) 0 to 5 parts by weight of a further fluorescent whitening agent and/or shading colourant and/or further auxiliaries.

The whitening compositions according to the invention are excellently suitable for whitening the optionally pigmented coating compositions customarily used in the textile, paint, adhesives, plastics, wood and paper industries. Such coating compositions comprise, as binders (co-binders), plastics dispersions based on copolymers of butadiene and styrene, of naphthalene sulphonic acids and formaldehyde, of polyethylene and polypropylene oxides, of acrylonitrile, butadiene and styrene, of acrylic acid esters, of ethylene and vinyl chloride and of ethylene and vinyl acetate, or homopolymers, such as polyvinyl chloride, polyvinylidene chloride, polyethylene, polyvinyl acetate, polyvinyl alcohol, or polyurethane.

If desirable, the coating composition may, in addition to the whitening composition, contain further fluorescent whitening agents and/or shading dyes or pigments.

For the purpose of pigmenting the coating compositions there are generally employed aluminium silicates, such as China clay or kaolin, and also barium sulphate, satin white, titanium dioxide or calcium compounds. These are described by way of example in J. P. Casey "Pulp and Paper; Chemistry and Chemical Technology", 2nd Ed. Vol. III; p. 1648-1649 and in McGraw-Hill "Pulp and Paper Manufacture", 2$^{nd}$ Ed. Vol. II, p. 497 and in EP-A-0 003 568.

The whitening compositions according to the invention may be used especially for the coating of paper, more especially ink-jet and photographic paper, wood, foils, textiles, non-woven materials and suitable building materials. Special preference is given to use on paper and cardboard and on photographic and ink-jet papers.

Consequently, a further aspect of the invention is paper, which has been treated with a coating composition as described above, with the composition of the invention or with a size press or film press liquor composition, as described below.

The composition may be applied to the substrate by coating using any type of coating equipment such as a blade coater, roll coater etc.

In addition to coating, the composition of the invention may be applied to the paper surface as an aqueous liquor by means of a size press or film press.

Thus, a further aspect of the invention is a size press or film press liquor composition, useful for the optical brightening of paper, comprising a) 0.001 to 2%, preferably 0.1 to 1%, by weight of the fluorescent whitening composition of the invention;
b) 1 to 20%, preferably 2 to 15% and most preferably 7 to 12% by weight of one or more binders, for example anionic starch;
c) 0 to 10% by weight of pigment and/or further auxiliaries and water to 100%.

The coating composition or size press or film press liquor composition may contain, as a further auxiliary, binders, agents for improving rheology and printability, fixing agents, wet-strength agents, antifoams and/or biocides. Examples of binders are polyvinyl alcohols, polyvinyl acetate, acrylic ester/styrene co-polymers, carboxylated styrene/butadiene co-polymers, polyvinyl pyrrolidone, oxidized starch, carboxymethyl cellulose and other water-soluble cellulose derivatives, whilst, for example, polyacrylamides and co-polymers thereof may serve to improve rheology and printability.

The coatings or coverings so obtained have, in addition to a high degree of fastness to light, an excellent degree of whiteness.

The following Examples illustrate the invention, without intending to be restrictive in nature; parts and percentages are by weight unless otherwise stated.

A. Preparation of Polymers

General Procedure

A reactor is charged with a mixture of 100 g of water and 0.5 ml of a 6% aqueous solution of Tetralon® B, the mixture stirred and heated to 95° C., when the specified quantity of ammonium persulphate (see Table 1) is then added. To this mixture, 600 g of a 50% aqueous acrylamide solution in 300 g of water is continuously fed over a period of 2 hours 15 minutes whilst, simultaneously, solutions of the specified amount of ammonium persulphate (see Table 1) in 50 ml of water and of the specified amount of sodium hypophosphite (see Table 1) in 40 ml of water are continuously fed to the reactor over a period of 3 hours. After the addition, the reaction mixture is stirred for a further 30 minutes at 95° C., cooled to 65° C. and treated with a solution of 2 g of sodium metabisulphite in 20 g of water. Stirring is continued for a further 1 hour at 65° C. and cooled, whereupon an aqueous solution containing the indicated percentage (see Table 1) of the appropriate polymer is obtained.

The amounts of the reagents used and the weight average molecular weights of the respective polymers obtained are summarized in the following Table 1:

TABLE 1

| Polymer No. | Total Ammonium Persulphate | Sodium Hypophosphite | Dry Weight of Polymer | Average Molecular Weight |
|---|---|---|---|---|
| P. 101 | 6 g | 6 g | 33.7% | 1,590 |
| P. 102 | 3 g | 6 g | 33.6% | 5,540 |
| P. 103 | 3 g | 3 g | 33.1% | 14,300 |

By proceeding as described above, but replacing the acrylamide by mixtures of either acrylamide and acrylic acid or acrylamide and dimethylacrylamide (DMACM), the copolymers summarized in the following Table 2 were obtained by employing the amounts of chain transfer reagent (sodium hypophosphite) and of the respective initiators indicated in the Table.

TABLE 2

| Polymer No. | % Acrylamide | % Co-monomer | % Initiator[1] | % Sodium hypophosphite | Dry weight | Average MW |
|---|---|---|---|---|---|---|
| P 104 | 95 | 5 Acrylic acid | 1.0 APS | 1.5 | 33.2% | 20,400 |
| P 105 | 95 | 5 Acrylic acid | 2.5 APS | 2.5 | 32.5% | 6,300 |
| P 106 | 90 | 10 Acrylic acid | 1.0 APS | 1.0 | 32.9% | 21,200 |
| P 107 | 90 | 10 Acrylic acid | 2.0 APS | 2.5 | 33.4% | 6,850 |
| P 108 | 75 | 25 Acrylic acid | 1.0 APS | 1.0 | 31.8% | 21,900 |
| P 109 | 75 | 25 Acrylic acid | 2.0 APS | 2.0 | 32.5% | 7,320 |
| P 110 | 50 | 50 Acrylic acid | 2.0 APS | 2.0 | 33.5% | 19,900 |
| P 111 | 50 | 50 Acrylic acid | 2.5 APS | 3.0 | 34.3% | 1,360 |
| P 112 | 25 | 75 Acrylic acid | 1.5 APS | 2.0 | 31.9% | 19,800 |
| P 113 | 25 | 75 Acrylic acid | 2.5 APS | 2.5 | 33.5% | 11,600 |
| P 114 | 95 | 5 DMACM | 1.0 V50 | 2.0 | 35.3% | 23,800 |
| P 115 | 95 | 5 DMACM | 2.0 V50 | 2.5 | 34.3% | 5,760 |
| P 116 | 90 | 10 DMACM | 1.0 V50 | 2.0 | 34.5% | 15,900 |
| P 117 | 90 | 10 DMACM | 2.0 V50 | 2.0 | 34.1% | 6,250 |
| P 118 | 75 | 25 DMACM | 1.0 V50 | 1.0 | 35.2% | 18,000 |
| P 119 | 75 | 25 DMACM | 2.0 V50 | 2.5 | 32.1% | 2,980 |
| P 120 | 50 | 50 DMACM | 1.0 V50 | 1.5 | 37.5% | 21,100 |
| P 121 | 50 | 50 DMACM | 2.0 V50 | 2.5 | 37.9% | 8,250 |
| P 122 | 25 | 75 DMACM | 1.0 V50 | 1.5 | 43.3% | 17,000 |
| P 123 | 25 | 75 DMACM | 2.0 V50 | 1.5 | 40.3% | 4,250 |

Remarks: [1]the initiators for the polymerisation are either ammonium persulphate (APS) or V50, which is a commercial product available from Wako Chemicals, the chemical name of which is 2,2-azodiisobutyramidine dihydrochloride, CAS Reg. Nr. 2997-92-4.

B. Fluorescent Whitening Agents

The structural formulae of the FWA's of general formula (1a) employed are summarized in the following Table 3:

(1a)

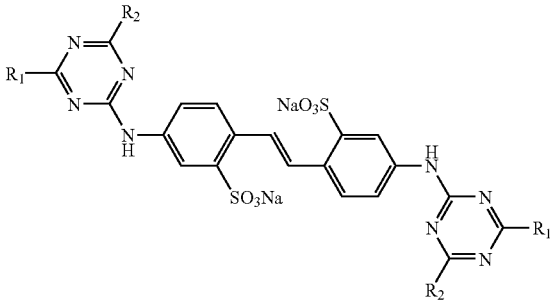

TABLE 3

| FWA No. | $R_1$ | $R_2$ |
|---|---|---|
| FW.201 | $—N(CH_2CH_2OH)_2$ | 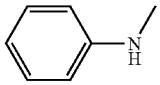 |
| FW.202 | $—N(CH_2CH_2OH)_2$ | 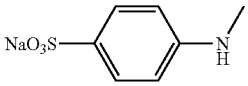 |
| FW.203 | $—N(CH_2CHCH_3)_2$ (OH) | 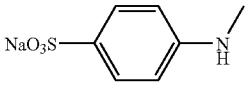 |

TABLE 3-continued

| FWA No. | $R_1$ | $R_2$ |
|---|---|---|
| FW.204 | $—N(CH_2CH_3)_2$ | 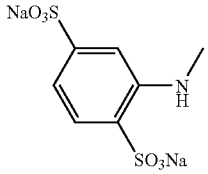 |
| FW.205 | $—NHCH_2CH_2OH$ | $—NHCH_2CH_2OH$ |

C. Coating Application

An aqueous coating colour having a solids content of 64% is prepared consisting of 70 parts of calcium carbonate and 30 parts of clay as inorganic pigment, 9 parts of SBR latex binder, 0.25 parts of a polyacrylic based viscosity modifier and 0.2 parts of polyvinyl alcohol and the pH adjusted to 8.5 by the addition of 0.17 parts of 4N aqueous sodium hydroxide solution. To the coating colour, a solution of the composition of the invention comprising 0.4 parts of the appropriate fluorescent whitening agent and 0.8 parts of the appropriate polymer (both parts by weight based on the total weight of inorganic pigment).

The final coating colour is applied to a neutral sized, FWA-free base paper having a weight of 85 g/m$^2$ using a draw down rod to achieve a final coat weight of 10 g/m$^2$ and the paper dried and conditioned. The degree of whiteness, W(CIE), and ISO fluorescence, F(ISO), of the resulting sheets are then measured using a Datacolor Elrepho 3000 spectrophotometer. The results are summarized in the following Table 4:

TABLE 4

| Example No. | Polymer | FWA | W(CIE) | F(ISO) |
|---|---|---|---|---|
| | None | None | 74.3 | 0.0 |
| | None | FW 201 | 96.5 | 7.4 |
| 1 | P 101 | FW 201 | 98.0 | 8.0 |
| 2 | P 102 | FW 201 | 97.6 | 7.8 |
| 3 | P 103 | FW 201 | 98.3 | 8.1 |
| | None | FW 202 | 92.2 | 6.3 |
| 4 | P 101 | FW 202 | 97.6 | 8.2 |
| 5 | P 102 | FW 202 | 97.6 | 8.2 |
| 6 | P 103 | FW 202 | 97.8 | 8.3 |
| | None | FW 203 | 92.4 | 6.1 |
| 7 | P 101 | FW 203 | 101.8 | 10.4 |
| 8 | P 102 | FW 203 | 103.4 | 10.9 |
| 9 | P 103 | FW 203 | 101.7 | 10.4 |
| | None | FW 204 | 98.4 | 7.8 |
| 10 | P 101 | FW 204 | 103.6 | 9.6 |
| 11 | P 102 | FW 204 | 102.4 | 9.2 |
| 12 | P 103 | FW 204 | 102.3 | 9.2 |
| | None | FW 205 | 94.3 | 6.8 |
| 13 | P 101 | FW 205 | 95.7 | 7.3 |
| 14 | P 102 | FW 205 | 96.2 | 7.5 |
| 15 | P 103 | FW 205 | 96.0 | 7.5 |

The results in Table 4 clearly demonstrate the increase in whiteness and fluorescence resulting from the addition of the composition of the invention.

In a further series of experiments, coating colours were prepared as described above, but also containing polyethylene glycol (PEG) according to a further aspect of the composition of the invention.

The results are summarized in Table 5 below:

TABLE 5

| Example No. | Composition | W(CIE) | F(ISO) |
|---|---|---|---|
| | Without FWA, Polymer and PEG | 74.2 | 0.0 |
| | 0.4 parts FW 204 | 95.8 | 7.0 |
| 16 | 0.4 parts FW 204 + 1.0 part PEG 1500 | 103.1 | 9.0 |
| 17 | 0.4 parts FW 204 + 1.0 part P 102 | 104.7 | 9.8 |
| 18 | 0.4 parts FW 204 + 0.5 parts P 102 + 0.5 parts PEG 1500 | 105.2 | 9.7 |

The above results not only demonstrate the superior boosting effect of the composition of the invention, but also demonstrate the synergistic influence of the combination of polymer together with polyethylene glycol.

In another series of experiments, coatings were prepared as described above, having an average coat weight of 13.7 g/m$^2$, containing a composition according to the invention of 0.4 and 0.8 parts by weight of active substance (based on the total weight of inorganic pigment) of FW 204 and the copolymers described in Table 2, at a ratio of 1 part by weight FWA to 2.3 parts by weight of copolymer.

The results are summarized in the following Table 6:

TABLE 6

| Example No. | Copolymer | Parts FW 204 | W(CIE) | F(ISO) |
|---|---|---|---|---|
| | None | None | 74.9 | 1.5 |
| | None | 0.4 | 99.4 | 9.8 |
| | None | 0.8 | 95.2 | 9.2 |
| 19 | P 104 | 0.4 | 103.5 | 11.1 |
| 20 | P 104 | 0.8 | 110.2 | 13.9 |
| 21 | P 105 | 0.4 | 103.3 | 11.1 |
| 22 | P 105 | 0.8 | 110.8 | 14.1 |
| 23 | P 106 | 0.4 | 102.5 | 10.8 |
| 24 | P 106 | 0.8 | 109.8 | 13.7 |
| 25 | P 107 | 0.4 | 102.9 | 10.9 |
| 26 | P 107 | 0.8 | 110.9 | 14.2 |
| 27 | P 108 | 0.4 | 102.2 | 10.6 |
| 28 | P 108 | 0.8 | 107.4 | 12.9 |
| 29 | P 109 | 0.4 | 102.2 | 10.6 |
| 30 | P 109 | 0.8 | 107.6 | 12.9 |
| 31 | P 110 | 0.4 | 101.6 | 10.4 |
| 32 | P 110 | 0.8 | 103.3 | 11.6 |
| 33 | P 111 | 0.4 | 101.4 | 10.4 |
| 34 | P 111 | 0.8 | 104.0 | 12.0 |
| 35 | P 112 | 0.4 | 100.3 | 10.0 |
| 36 | P 112 | 0.8 | 101.3 | 10.9 |
| 37 | P 113 | 0.4 | 100.0 | 10.0 |
| 38 | P 113 | 0.8 | 101.7 | 11.1 |
| 39 | P 114 | 0.4 | 103.8 | 11.3 |
| 40 | P 114 | 0.8 | 111.8 | 14.5 |
| 41 | P 115 | 0.4 | 103.7 | 11.3 |
| 42 | P 115 | 0.8 | 111.6 | 14.4 |
| 43 | P 116 | 0.4 | 104.1 | 11.4 |
| 44 | P 116 | 0.8 | 112.2 | 14.6 |
| 45 | P 117 | 0.4 | 104.1 | 11.3 |
| 46 | P 117 | 0.8 | 112.4 | 14.6 |
| 47 | P 118 | 0.4 | 104.1 | 11.3 |
| 48 | P 118 | 0.8 | 112.4 | 14.5 |
| 49 | P 119 | 0.4 | 104.4 | 11.5 |
| 50 | P 119 | 0.8 | 112.6 | 14.6 |
| 51 | P 120 | 0.4 | 104.5 | 11.5 |
| 52 | P 120 | 0.8 | 113.4 | 14.8 |
| 53 | P 121 | 0.4 | 105.0 | 11.6 |
| 54 | P 121 | 0.8 | 113.6 | 14.9 |
| 55 | P 122 | 0.4 | 104.8 | 11.5 |
| 56 | P 122 | 0.8 | 113.5 | 14.7 |
| 57 | P 123 | 0.4 | 105.3 | 11.7 |
| 58 | P 123 | 0.8 | 114.3 | 15.0 |

The above results not only demonstrate the excellent boosting effect of the copolymers, but also demonstrate, as opposed to FW 204 alone, that increasing FWA concentration also results in increased degree of whiteness, due to a reduced tendency towards greening at higher concentrations, a much-desired attribute for producing papers of extremely high whiteness levels.

D Size Press Application

To 100 g of an aqueous solution containing 8.0 g of anionic starch, the composition of the invention containing 0.3 g of the appropriate fluorescent whitening agent (FWA) and 0.3 g of the appropriate polymer are added.

This solution is applied to a wood- and FWA-free base paper having a weight of 80 g/m$^2$ by means of a size press, such that the pick-up corresponds to 24%.

After drying and conditioning, the degree of whiteness, W(CIE), and ISO fluorescence, F(ISO), of the resulting sheets are measured using a Datacolor Elrepho 3000 spectrophotometer.

The results are summarized in the following Table 7:

TABLE 7

| Example No. | Polymer | FWA | W(CIE) | F(ISO) |
|---|---|---|---|---|
| | None | None | 68.1 | 0.0 |
| | None | FW 201 | 108.3 | 13.4 |
| 59 | P 101 | FW 201 | 107.6 | 13.2 |
| 60 | P 102 | FW 201 | 108.2 | 13.4 |
| 61 | P 103 | FW 201 | 108.5 | 13.7 |
| | None | FW 202 | 109.4 | 13.7 |
| 62 | P 101 | FW 202 | 109.5 | 13.7 |
| 63 | P 102 | FW 202 | 109.0 | 13.6 |
| 64 | P 103 | FW 202 | 110.3 | 14.0 |
| | None | FW 204 | 113.3 | 14.2 |
| 65 | P 101 | FW 204 | 114.3 | 14.6 |
| 66 | P 102 | FW 204 | 114.3 | 14.6 |
| 67 | P 103 | FW 204 | 115.1 | 14.9 |
| | None | FW 205 | 113.5 | 15.7 |
| 68 | P 101 | FW 205 | 115.0 | 16.1 |
| 69 | P 102 | FW 205 | 115.1 | 16.2 |
| 70 | P 103 | FW 205 | 113.8 | 15.8 |

Again, in the majority of cases, the boosting effect of the composition of the invention is clearly demonstrated.

The invention claimed is:

1. A composition comprising a) at least one water-soluble fluorescent whitening agent, b) a water-soluble polymer consisting of acrylamide only or acrylamide and other monomers, said monomers are selected from the group consisting of methacrylamide, N-alkyl acrylamides, N-alkyl methacrylamides, N-hydroxy acrylamides, N,N-dialkyl acrylamides, N,N-dialkyl methacrylamides, N,N-di(hydroxyalkyl) acrylamides, morpholino acrylamide, acrylic acid, methacrylic acid, itaconic acid, crotonic acid, 2-acrylamido-2-methylpropane sulphonic acid, allyl sulphonic acid and vinyl sulphonic acid, whereby the acidic monomers are in the form of their free acid or water-soluble salts and the water-soluble polymer has an average (weight average) molecular weight of between 500 and 49,000, optionally, c) polyethylene glycol with a weight average molecular weight of between 500 and 6000 and d) water.

2. A composition according to claim 1, wherein the fluorescent whitening agent is selected from a compound of the formula (1)

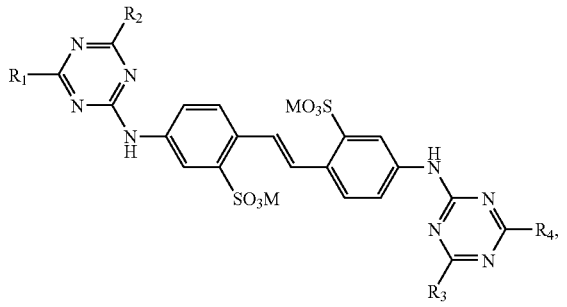

wherein $R_1$, $R_2$, $R_3$ and $R_4$ each, independently, represent —$NH_2$, —$OC_1$-$C_4$alkyl, —Oaryl, —$NHC_1$-$C_4$alkyl, —N($C_1$-$C_4$alkyl)$_2$, —N($C_1$-$C_4$alkyl)($C_1$-$C_4$hydroxyalkyl), —$NHC_1$-$C_4$hydroxyalkyl, —N($C_1$-$C_4$hydroxyalkyl)$_2$, or —NHaryl, whereby aryl is phenyl, which may be unsubstituted or substituted by one or two sulphonic acid groups, —COOH, —$COOC_1$-$C_4$alkyl, —$CONH_2$, —$CONHC_1$-$C_4$alkyl or by —CON($C_1$-$C_4$alkyl)$_2$, a morpholino, piperidino or pyrrolidino residue, —$SC_1$-$C_4$alkyl or aryl, or an amino acid or amino acid amide residue from which a hydrogen atom has been abstracted from the amino group and M represents hydrogen, an alkaline or alkaline earth metal, ammonium or ammonium that is mono-, di-, tri- or tetrasubstituted by $C_1$-$C_4$alkyl or $C_2$-$C_4$hydroxyalkyl and from a compound of the formula (2)

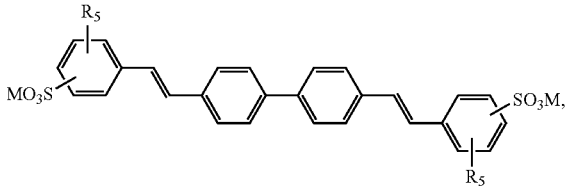

wherein $R_5$ represents hydrogen, chlorine or $C_1$-$C_4$alkoxy and M is as defined above, and mixtures thereof.

3. A composition according to claim 1, wherein the polymer comprises repeating units that are derived from acrylamide only.

4. A composition according to claim 1, wherein the ratio of the water-soluble fluorescent whitening agent, component a), to polymer, component b), is from 1:0.1 to 1:5 parts by weight and the composition contains at least 20% by weight of water.

5. A method for the fluorescent whitening of paper, comprising contacting said paper with an effective amount of a composition according to claim 1.

6. A paper coating composition comprising an inorganic pigment and 0.01 to 10 parts by weight of the composition according to claim 1, (i) from 3 to 25 parts by weight of binder and co-binder, (ii) 0 to 1 part by weight of rheology modifier, (iii) 0 to 2 parts by weight of wet-strength agent and (iv) 0 to 5 parts by weight of a further fluorescent whitening agent and/or shading colourant and/or further auxiliaries, wherein all parts by weight are based on 100 parts by weight of the inorganic pigment.

7. A size press or film press liquor composition, useful for the optical brightening of paper, comprising a) 0.001 to 2% by weight of the fluorescent whitening composition, according to claim 1;

b) 1 to 20% by weight of one or more binders;

c) 0 to 10% by weight of pigment and/or further auxiliaries and d) water to 100%.

8. A method for the fluorescent whitening of paper comprising contacting said paper with an effective amount of a composition according to claim 6.

9. An article of manufacture comprising paper that is treated with a composition according to claim 1.

10. A method for the fluorescent whitening of paper comprising contacting said paper with an effective amount of a composition according to claim 7.

11. An article of manufacture comprising paper that is treated with a composition according to claim 6.

12. An article of manufacture comprising paper that is treated with a composition according to claim 7.

13. A composition comprising a) at least one water-soluble fluorescent whitening agent selected from a compound of the formula (1)

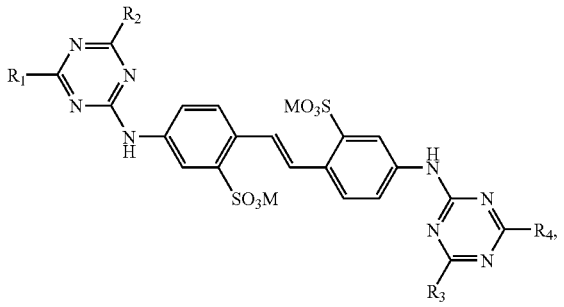

wherein $R_1$, $R_2$, $R_3$ and $R_4$ each, independently, represent —$NH_2$, —$OC_1$-$C_4$alkyl, —Oaryl, —$NHC_1$-$C_4$alkyl, —N($C_1$-$C_4$alkyl)$_2$, —N($C_1$-$C_4$alkyl)($C_1$-$C_4$hydroxyalkyl), —$NHC_1$-$C_4$hydroxyalkyl, —N($C_1$-$C_4$hydroxyalkyl)$_2$, or —NHaryl, whereby aryl is phenyl, which may be unsubstituted or substituted by one or two sulphonic acid groups, —COOH, —$COOC_1$-$C_4$alkyl, —$CONH_2$, —$CONHC_1$-$C_4$alkyl or by —CON($C_1$-$C_4$alkyl)$_2$, a morpholino, piperidino or pyrrolidino residue, —$SC_1$-$C_4$alkyl or aryl, or an amino acid or amino acid amide residue from which a hydrogen atom has been abstracted from the amino group and M represents hydrogen, an alkaline or alkaline earth metal, ammonium or ammonium that is mono-, di-, tri- or tetrasubstituted by $C_1$-$C_4$alkyl or $C_2$-$C_4$hydroxyalkyl, b) water-soluble polymer consisting of acrylamide only or acrylamide and other monomers, said monomers are selected from the group consisting of methacrylamide, N-alkyl acrylamides, N-alkyl methacrylamides, N-hydroxy acrylamides, N,N-dialkyl acrylamides, N,N-dialkyl methacrylamides, N,N-di(hydroxyalkyl) acrylamides, morpholino acrylamide, acrylic acid, methacrylic acid, itaconic acid, crotonic acid, 2-acrylamido-2-methylpropane sulphonic acid, allyl sulphonic acid and vinyl sulphonic acid, whereby the acidic monomers are in the form of their free acid or water-soluble salts, and the water-soluble polymer has an average (weight average) molecular weight of between 500 and 49,000, c) polyethylene glycol with a weight average molecular weight of between 500 and 6000 and d) water.

14. The composition according to claim 13, wherein the water soluble polymer is formed from acrylamide only.

* * * * *